United States Patent [19]

Hartmann et al.

[11] 4,036,865

[45] July 19, 1977

[54] SEMICONTINUOUS PROCESS FOR DEODORIZING OILS

[75] Inventors: Albert Hartmann, Heusenstamm; Herbert Schilken, Friedberg; Bernhard Romeiser, Hanau, all of Germany

[73] Assignee: Metallgesellschaft Aktiengesellschaft, Frankfurt am Main, Germany

[21] Appl. No.: 626,337

[22] Filed: Oct. 28, 1975

Related U.S. Application Data

[63] Continuation of Ser. No. 485,290, July 2, 1974, abandoned.

[30] Foreign Application Priority Data

July 18, 1973 Germany ..... 2336639

[51] Int. Cl.[2] ..... C11B 3/14

[52] U.S. Cl. ..... 260/428; 55/40; 55/54; 55/55; 55/89; 55/93; 99/495; 99/517; 99/534; 165/66; 165/108; 203/78; 203/79; 203/85; 203/92; 203/93; 203/96; 426/417; 426/476; 426/488; 426/492

[58] Field of Search ..... 426/601, 629, 630, 632, 426/635, 417, 475, 476, 487, 488, 490, 492, 506, 507, 511, 520, 524; 203/85, 96, 97, 78, 79, 80, 92, 93; 260/428; 210/71, 175, 177, 180; 55/36, 54, 89, 198, 208, 55, 38, 40, 84, 93; 99/483, 495, 496, 516, 517, 534; 165/66, 108, DIG. 12

[56] References Cited

U.S. PATENT DOCUMENTS

| | | | |
|---|---|---|---|
| 2,280,896 | 4/1942 | Dean | 260/428 |
| 2,512,045 | 6/1950 | Steinberg et al. | 165/66 X |
| 2,746,867 | 5/1956 | Werly | 426/417 |
| 2,978,327 | 4/1961 | Rasmussen | 426/488 |
| 2,991,298 | 7/1961 | Raffaeta | 203/85 |
| 3,506,696 | 4/1970 | Baker et al. | 260/428 |
| 3,542,653 | 11/1970 | Lowrey et al. | 203/96 X |
| 3,933,953 | 1/1976 | Leva | 426/488 X |

*Primary Examiner*—Arthur L. Corbin
*Attorney, Agent, or Firm*—Karl F. Ross; Herbert Dubno

[57] ABSTRACT

A liquid feed stock containing oil is deodorized in a semicontinuous process wherein the feed stock, in a first evacuated chamber, undergoes heat exchange with a deodorized stock in a second evacuated chamber, said stocks being circulated in their respective chambers by upwardly flowing steam introduced into each chamber between a partition, separating the two chambers, and a guide plate parallel to said partition and spaced therefrom, whereafter said feed stock is passed through a succession of steam heating stages to heat said feed stock to successively higher temperatures thereby deodorizing the feed stock and then withdrawn as deodorized stock and recirculated as deodorized stock to said second evacuated chamber to undergo heat exchange with said feed stock.

3 Claims, 4 Drawing Figures vacuum
closed inlet chamber
12
plates
11
partition
13
guide plates
3a
Ia
steam
Ib
I
nozzle tubes
10
steam
valve
valve
4
7a
vacuum
container
2
conduit
steam
II
steam
3
valve
valve
14
steam
5
conduit
9
III
steam
conduit
valve
6
steam
IV
steam
conduit
7
8
valve
pump
splashed oil
17
cooling cycle
V
18
cooling stage
steam
18a
cooler
19
cooling water
steam
15
16
super-heated steam
pumped refined product
1

SEMICONTINUOUS PROCESS FOR DEODORIZING OILS

This is a continuation of application Ser. No. 485,290, filed July 2, 1974, now abandoned.

FIELD OF THE INVENTION

This invention relates to a semi-continuous process of deodorizing fats and oils.

BACKGROUND OF THE INVENTION

In the production of edible oils and edible fats the oil is refined and neutralized and bleached oil is then supplied to a deodorizing stage, in which the undesired flavoring and olfactory or noisome substances are removed. These substances consist mainly of alcohols, ketones, aldehydes, and low-molecular fatty acids and, more recently, of traces of chlorine-containing pesticides.

These substances are basically subjected at elevated temperatures and under reduced pressure in a closed apparatus to distillation in entraining steam. The processes involved have been described in "Chemikerzeitung" 88, pages 412 et seq.

The process can be carried out as a batch process, a semicontinuous process or a continuous process (Fette, Seifen, Anstrichmittel 72, pages 166 et seq., 1970).

The general trend is from the old batchwise process to a continuous process. Whereas the continuous process has the advantage that the continuous feeding and discharge permits heat exchange between the incoming and outgoing products, it has the disadvantage that a remixing may take place in the deodorizer so that the residence time of the product to be deodorized is not exactly defined, as the flow of one part of the oil through the deodorizer is slower than the rest of the oil. A constant defined residence time in the several stages of the continuous process cannot be ensured. Besides, a rapid change of the charge is not possible.

The continuous process has been restricted heretofore to such refined products which can easily be deodorized. With oils and fats which can be refined only with difficulty and in case of a frequent change of product, the semicontinuous process is used more frequently, which is a modification of the discontinuous process. In the semicontinuous process, the charge flows through a closed multiple-stage apparatus, which comprises separate, closed stages which are arranged one over the other. A process control system is used for an optimum control of the temperature, addition of steam, residence time, and the performance of the deodorizing process.

That process permits a variation of the rate, residence time, and change of products within wide limits.

It has been proposed to improve the semicontinuous process by continuously feeding the product to the first stage of the plant and continuously discharging the product from the last stage whereas the intervening stages are intermittently operated in alternation. This practice enables a direct heat exchange in a separate heat exchanger between the hot product as it is discharged and the cold product as it is fed.

The procedure has the disadvantage that owing to the continuous feeding and discharge and treating time of the oil in the first and last stages is not uniform. Here too, portions of the oil are created for a longer or shorter time. A requirement for this process resides in that one and the same product must be processed for long periods of time and there is no frequent change of product.

It is also known to heat the first stage by a closed cycle of a heat carrier and to reheat the cooled heat carrier by the heated product in one of the subsequent stages.

Where a heat carrier consisting, e.g., of heat transfer oil, water or glycerine is used, two stages are provided in most cases with heating and cooling systems and the heat carrier circulates in the interconnected cooling and heating systems. Such plants involve a relatively high capital expenditure. Besides the heat exchange is reduced because there are two heat transfers between the product to be cooled and the heat carrier and between the product to be heated and the heat carrier.

OBJECT OF THE INVENTION

It is an object of the invention to avoid these disadvantages and to provide a semicontinuous process in which the charges are intermittenly treated and exactly defined residence time are maintained so as to enable a direct heat exchange between the product to be heated and the product to be cooled, which heat exchange is effected under reduced pressure in a closed apparatus and without a heat carrier independently of the materials processed in the system.

SUMMARY OF THE INVENTION

This object is accomplished in that in the first stage the feed product is heated by a direct heat exchange with the pump-off product from a heated stage, particularly the last and the pump-off product which has been cooled by said heat exchange is fed to the last stage, which is provided with indirect cooling means.

According to a preferred feature of the invention the heat exchange between the feed product and the pumped-off product is promoted in that the two charges are separately recirculated along partitions of the first stage.

According to another preferred embodiment of the invention the recirculation along the partitions in the first stage is accomplished by means of propelling steam or an inert gas in a gaplike space defined between guide plates and the partition.

For instance, where propelling steam is used, the process according to the invention has the advantage that the heat exchange in a partial vacuum is accompanied by a degasification and drying of the material, by a pre-deodorization of the feed product and an additional deodorization of the pumped-off product.

The special advantage of the process is the simple and fast heat exchange with a defined residence time because the residence time is highly significant for the quality and stability of the oil or fat.

The invention thus is a semi-continuous process for deodorizing a feed containing oils or fats which comprises the steps of:

a. intermittently passing quantities of the feed through a succession of heating stages;

b. steam-heating the feed in said succession of stages to successively higher temperatures;

c. withdrawing at least a portion of the feed from at least one stage subsequent to the first; and d. passing the withdrawn portion in heat exchange with the feed in the first stage.

BRIEF DESCRIPTION OF THE DRAWING

The process will be described more in detail and by way of illustration with reference to the drawings.

SPECIFIC DESCRIPTION

Figure 1:
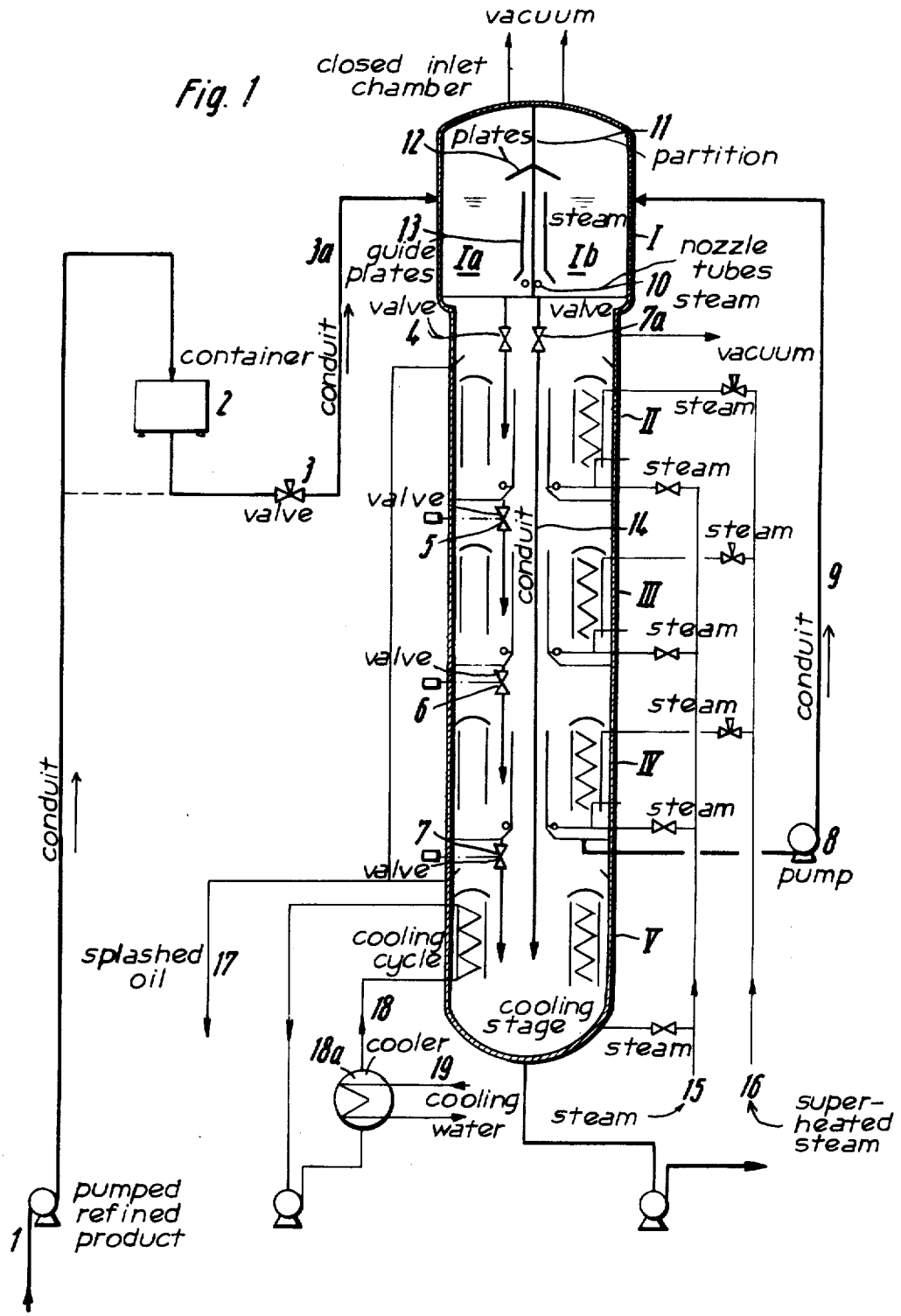
FIG. 1 is a flow scheme showing a deodorizing plant.

The refined product, which is at or slightly above room temperature, is fed in conduit 1 by a pump to a container 2, from which the weight quantity is fed through a valve 3 through conduit 3*a* to the heat exchange stage I of the deodorizer until the closed inlet chamber I*a* of stage I is filled. Alternatively, the feeding may be direct and may be controlled by a level control contact or the like in stage I. The product is then subjected to a heat exchange with a hot charge, e.g., from stage IV of the deodorizer. After that heat exchange, which will be described herein-after, the heated product flows through valve 4 into the next stage II and after the treatment in stage II flows through valve 5 into the next stage disposed underneath, etc.

Before the product enters the lowermost stage V, it is pumped back by a pump 3 which is free of stuffing boxes through conduit 9 into the separate cooling chamber I*b* of stage I, in which the now hot, pretreated product from stage IV is subjected for a predetermined residence time to a heat exchange with additionally fed product in chamber I*a*.

To intensify the heat exchange, propelling steam under a pressure of 0.5 kilogram per square centimeter above atmospheric pressure emerges from the conduits 10*a* through nozzle tubes 10. To recirculate the oil, the steam flows upwardly along the partition 11 in a gap 11*a*, which is defined by partition 11 and guide plates 13. The partition 11 is provided with swirling and deflecting plates 12. This recirculation occurs in both chambers I*a* and I*b*. After a predetermined residence time and when the feed oil or fat has been heated, the cooled product in chamber I*a* flows through valve 7*a* and conduit 14 directly into the last stage V. This is a cooling stage, in which the oil is cooled in about 100° C. by an indirect heat exchange with recirculated cooling water.

In the stages II–IV, the oil is deodorized by a supply of direct steam from conduit 15. To heat the oil to the end temperature of 200°–270° C., depending on the kind of oil or fat, superheated steam is fed through conduit 16 into stages II to IV.

In stages II to V oil is treated with steam from steam showers and by oil recirculators operating like gas-lift pumps. The heating and cooling systems are built in the recirculators. The upper portion of each stage contains collectors for collecting splashed oil. These collectors prevent a backflow of condensation products from the upper part of each stage into the deodorized oil or fat. The splashed oil is discharged through conduit 17.

Chamber I*a* is not connected to the same high vacuum as chamber I*b* and the remaining stages, but to a somewhat lower vacuum. This has the advantage that the vacuum fluctuations which may occur here, e.g., in case of a feeding of moist product, are not transmitted to the remaining stages so that the vacuum in the remaining stages is not disturbed.

A closed cooling cycle 18 is provided for the cooling of the oil or fat in the last stage V. In this case, e.g., condensate is recirculated through the cooling system of the last stage and is recooled by cooling water 19 in an external plate-type cooler 18*a*. This will prevent a formation of deposits by precipitated hardness constituents. The cooled oil or fat is then discharged from the cooling stage.

Figure 2A:
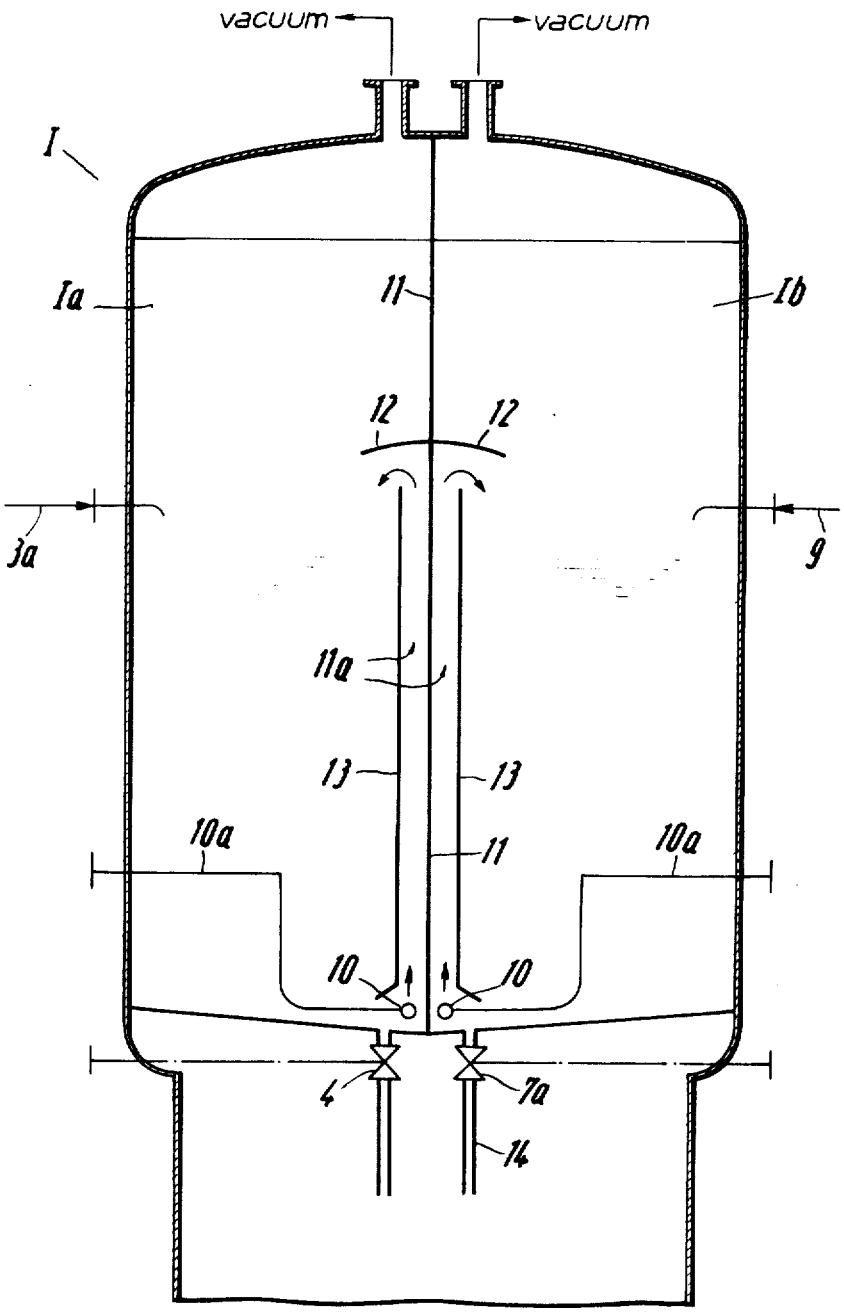
FIG. 2*a* is an enlarged longitudinal sectional view taken through stage I.
Figure 2B:
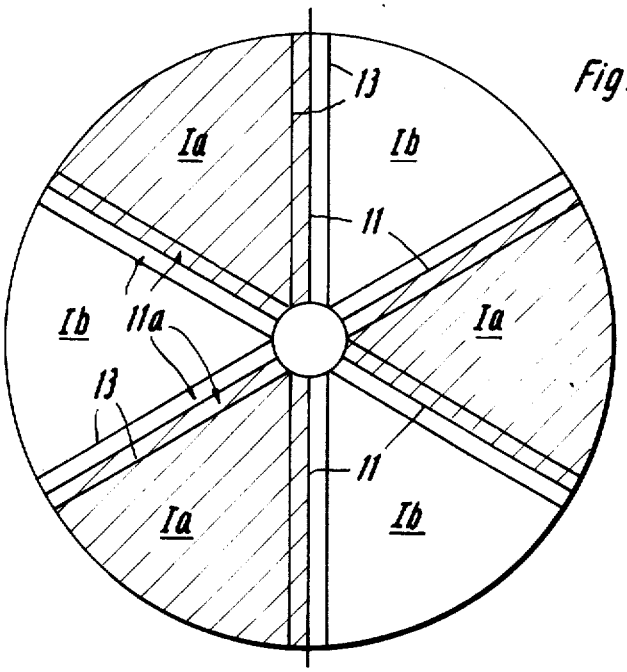
FIGS. 2*b* and 2*c* are transverse sectional views showing different embodiments of stage I.
Figure 2C:
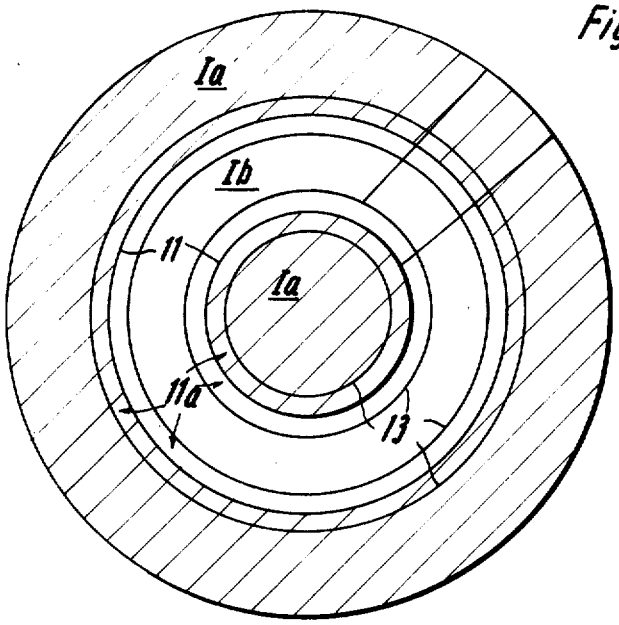

To further improve the heat exchange, stage I is desirably divided into a plurality of sections, which may have the form of sectors of a circle or of rings, as is shown in FIGS. 2*b* and 2*c*. The inlet chambers I*a* are hatched in both figures and may be jointly filled and emptied, just as the cooling chambers I*b*. The partitions 11 between adjacent sections may be straight plates or may be corrugated plates to improve the heat transfer. The guide plates 13 which are parallel thereto are arranged with such spacing that in conjunction with the propelling steam they result in an optium recirculation throughout the section. The nozzle tubes 10 (not shown in FIGS. 2*a* and 2*b*) consist of tubes which are provided at the top with holes. Other types of nozzles may be used to force the recirculating propelling steam into the gaps 11*a*.

Different from the showing in FIG. 1, stage I may be separate from the remaining apparatus.

In procedure according to the invention results in a simple and economic heat exchange in conjunction with a defined residence time in the first stage, and the recirculation of the oil results in a drying, heating and predeodorization of the feed oil and in an additional deodorization in the first stage of the product pumped from the fourth stage into the first stage. The heat exchange in the stages is highly intense and *k*-values up to 1000 kcal/m²-hr-°C are reached.

SPECIFIC EXAMPLE

EXAMPLE 1

From the measuring container 2, a charge of pretreated peanut oil at a temperature of 50° C. is sucked into the left-hand chamber of stage I. That chamber is under a residual pressure of about 30 millimeters mercury. At the same time, a soybean oil charge which has been deodorized in stages II, III and IV is pumped at a temperature of 240° C. from stage IV of the deodorizer into the right-hand chamber of stage I. Just as the remaining stages of the deodorizer, the right-hand chamber of stage I is under a residual pressure of about 4 millimeters mercury. Within stage I, the two different oil charges are recirculated at high velocity along the partition by direct steam injected under a pressure of 3 kilograms per square centimeter above atmospheric pressure. As a result, the peanut oil in the left-hand chamber is heated to 140° C., and the soybean oil in the right-hand chamber is cooled from 240° to 150° C.

The residence time in both chambers of stage I corresponds to the interval time of, e.g., 0.6–0.8 hour, which is predetermined for all stages of the deodorizer. After this interval of time, the two valves connected to the two chambers of stage I are opened (automatically or by hand) and the peanut oil flows at a temperature of 140° C. from the left-hand chamber into stages II–IV, in which it is indirectly heated with steam. From the right-hand chamber of stage I, the soybean oil flows at a temperature of 150° C. into the stage V, in which it is cooled from 150° C. to about 100° C. by means of cooling water.

EXAMPLE 2

In a deodorizing plant as shown in FIG. 1, having a capacity of 200 metric tons of oil per day, the heat exchange stage I was omitted and replaced by a normal deodorizing stage such as II–IV. That plant was fed in intervals of 0.8 hours with 30 charges of 7 metric tons of oil each at a temperature of 50° C. In stages II–IV the oil was heated by means of steam of 40 kilograms per square centimeter above atmospheric pressure from 50° to 240° C. and was deodorized at the latter temperature. The deodorized oil was cooled in stage V to about 100° C. with cooling water. 280 kilograms steam for heating and deodorizing were consumed per metric ton of oil.

EXAMPLE 3

For a comparison with Example 2, the same deodorizing plant was used as in Example 2 but the first stage consisted of the heat exchanger such as is shown as stage I in FIGS. 1 and 2.

The oil to be deodorized was heated in stage I from 50° C. to about 140° C. by a heat exchange with hot deodorized oil from stage IV, and the latter oil was thus cooled to about 150° C. The recirculation in the heat exchange stage I was effected with propellent steam under a pressure of 3 kilograms per square centimeter above atmospheric pressure. The oil which has been heated in stage I to 140° C. was then heated in stages II to IV with steam of 40 kilograms per square centimeter above atomspheric pressure to 240° C. and was deodorized at the latter temperature. The deodorized oil which had been cooled from 240° C. to about 150° C. in heat exchanger stage I was supplied to the cooling stage V and was cooled there with cooling water to about 100° C.

Compared to Example 2, 115 kilograms steam were saved per metric ton of oil. This is proof of the effectiveness of the novel process.

We claim:

1. A semicontinuous process for deodorizing liquid feed stock containing oil, comprising the steps of:

a. introducing the feed stock initially into a first evacuated chamber having a wall and a partition parallel to but spaced from said wall, introducing steam upwardly into said chamber at the base of said partition and between said partition and a first guide plate, parallel to and between said wall and said partition, to induce a circulation of the feed stock in said chamber, introducing deodorized stock into a second chamber adjacent said evacuated chamber and separated therefrom by said partition, and circulating said deodorized stock in said second chamber by introducing steam upwardly into a space between said partition and a second guide plate parallel to said partition and spaced from said first guide plate by said partition, said circulating deodorized stock indirectly heating said feed stock through said partition in heat exchanging relationship;

b. deodorizing the feed stock by intermittently passing the feed stock heated in step (a) through a succession of heating stages at subatmospheric pressure, each stage having a wall and a partition parallel to but spaced from said wall, while admitting steam at the base of the partition between the wall and the partition in each of said stages to circulate the feed stock therein between the wall and the partition and so as to heat the feed stock in said succession of stages to successively higher temperatures thereby deodorizing said feed stock;

c. withdrawing the feed stock from at least one of said heating stages subsequent to the first heating stage and passing it as said deodorized stock into said second chamber for indirect heat exchange with the initial feed stock in step (a);

d. withdrawing deodorized stock from said second chamber and cooling said withdrawn deodorized stock in a cooling stage; and e. discharging said cooled deodorized stock from said cooling stage.

2. The process defined in claim 1 wherein the heat exchange between the feed stock and deodorized stock is carried out with a residence time of 0.6 to 0.8 hours.

3. The process defined in claim 1 wherein said oil is peanut oil or soybean oil.

* * * * *